United States Patent [19]

Wilczynski et al.

[11] Patent Number: 4,778,219

[45] Date of Patent: Oct. 18, 1988

[54] JIGGING MACHINE

[75] Inventors: Peter Wilczynski, Dorsten; Werner Strauss, Bochum, both of Fed. Rep. of Germany

[73] Assignee: Klockner-Humboldt-Deutz AG, Fed. Rep. of Germany

[21] Appl. No.: 759,456

[22] Filed: Jul. 26, 1985

[30] Foreign Application Priority Data

Jul. 26, 1984 [DE] Fed. Rep. of Germany ..... 3427509

[51] Int. Cl.[4] ..... B03B 5/18; B03B 5/24; B03B 11/00

[52] U.S. Cl. ..... 299/8; 209/425; 209/437; 209/443; 209/492; 209/508; 209/935

[58] Field of Search ..... 209/422, 424, 427, 428, 209/429, 431, 432, 437, 440, 441, 443, 461, 462, 490, 492, 508, 935, 426, 425; 299/8; 406/168, 197

[56] References Cited

U.S. PATENT DOCUMENTS

| | | | |
|---|---|---|---|
| 204,996 | 6/1878 | Plumb | 209/492 X |
| 472,820 | 4/1892 | Roberts | 209/508 X |
| 1,225,158 | 5/1917 | Moyer | 209/427 |
| 1,260,749 | 3/1918 | Brown | 209/443 |
| 1,263,956 | 4/1918 | Sterrett | 209/508 X |
| 1,477,006 | 12/1923 | Riley et al. | 209/492 X |
| 1,728,196 | 9/1929 | Blatch | 209/427 X |
| 2,656,924 | 10/1953 | Thomas | 209/508 |
| 4,187,044 | 2/1980 | Chassagne | 406/197 |
| 4,222,867 | 9/1980 | Garland | 209/427 |

FOREIGN PATENT DOCUMENTS 3115247 11/1982 Fed. Rep. of Germany .

*Primary Examiner*—Douglas C. Butler
*Assistant Examiner*—Mary Beth O. Jones
*Attorney, Agent, or Firm*—Hill, Van Santen, Steadman & Simpson

[57] ABSTRACT

A jigging machine, particularly a movable sieve jigging machine, for the preseparation of deads from valuable material comprises an oscillatory jig bed in the housing filled with separating fluid and comprises deads and valuable material discharge devices located therein, as well as an oscillatory drive for the jig bed. The jigging machine is suitable for underground mining operations in that the outer dimensions of the jigging machine, with respect to the height and width theeof, are designed smaller than the tunnel cross-section of an underground mining operation. A relatively low structure is achieved by designing the housing as a flat trough towards a deads discharge end with the deads discharge being provided as a rising conveyor parallel to the bottom of the trough. Advantageously it is achieved that the quantity of deads to be conveyed is reduced and a considerable saving is provided in terms of energy and expense.

3 Claims, 4 Drawing Sheets

JIGGING MACHINE

BACKGROUND OF THE INVENTION

1. Field of the Invention

The present invention relates to a jigging machine, particularly to a movable sieve jig, for preseparation of deads, comprising an oscillating jig bed in a housing filled with parting fluid and comprising deads and valuable substance discharge devices disposed therein, as well as an oscillatory drive.

2. Description of the Prior Art

It is known that jig machines, particularly movable sieve jigs, are preferably employed for coal preparation. These known jigging machines which, in special preparation systems, are accommodated as close as possible to the mine shaft of the respective mines have extremely large dimensions, particularly with respect to the height and width thereof, so that they require a relatively large space.

The German published application No. 31 15 247 discloses a movable sieve jig for preseparation of deads for underground use. Due to its structural design, however, this movable sieve jig with a bottom deads and valuable substance discharge can be employed underground only stationarily in large operating spaces.

SUMMARY OF THE INVENTION

The object of the present invention is to improve the known jigging machine in terms of its structural format to such effect that it can be employed on-line in the underground mining area.

The above object is achieved, according to the present invention, in that the jigging machine has its external dimensions, with respect to height and width, designed smaller than the cross-section of a tunnel of an underground mining area. A jigging machine designed in such a manner has the advantage that it can be employed in the underground mining area at the location of the material mining operation for the preseparation of the deads from the valuable materials, for example coal. The particular advantage of the utilization of the jigging machine of the present invention in the underground mining area is that the deads, mined together with the valuable materials, can be separated from the valuable materials immediately at the mining location within the respective mine tunnel or in the proximity of the mining location and therefore need be transported only over slight distances and need not be conveyed above ground. As a consequence of reducing the quantity of deads ballast to be conveyed above ground together with the raw coal, this yields a considerable saving of energy and expense. Furthermore, the above ground dead stump is thereby significantly reduced in a very advantageous manner because the preseparated deads constituents can be disposed of directly underground.

In order to be able to conduct the jigging machine in the underground mining area along the migrating advance head or, respectively, longwall, the jigging machine, according to a particular feature of the invention, is provided with a displaceable support. The jigging machine of the present invention can therefore be very advantageously followed with the progressive underground mining area as a so-called semimobile device on, for example, a roller or on a carriage. The paths or, respectively, distances for the transport of the deads components remaining underground which are returned as filling material in those areas already mined are thereby shortened in an advantageous manner.

According to another feature of the invention, the jigging machine comprises an oscillatory drive of the jig bed comprising a horizontally arranged piston-cylinder unit. This enables a particularly low structure of the jigging machine due to the oscillatory drive which attacks flatly at the frame of the jig bed.

A particularly preferred, flat structure of the jigging machine is achieved when the housing is designed as a flat trough toward the deads discharge side and the deads discharge is a conveyor rising flatly in its plane of circulation, i.e. essentially parallel to the floor of the flat trough. Such high performance jigging machines can be manufactured in structural heights of about 6 m or even less and can also be moved in the underground tunnels (up to 8 m high). The jig bed which is rotationally movable at the discharge side enables a very high stroke and very large pieces can be processed on the jigging machine and can be discharged by way of conveyor elements. The deads discharge advantageously occurs via a conveyor rising in the plane of circulation essentially parallel to the floor cf the flat trough; the deads discharge usually lies opposite the material input.

There are several advantageous possibilities for the discharge of the valuable materials. A conveyor element attached above a conveyor for the de ds discharge, preferably parallel thereto, a conveyor element attached next to the conveyor for the deads discharge, or, in a particularly preferred manner, a screw above the jig bed which (with corresponding baffles) discharges laterally from the jigging machine, are various advantageous possibilities.

DESCRIPTION OF THE DRAWINGS

Other objects, features and advantages of the invention, its organization, construction and operation, will be best understood from the following detailed description, taken in conjunction with the accompanying drawings, on which.

DESCRIPTION OF THE PREFERRED EMBODIMENTS

Figure 1:
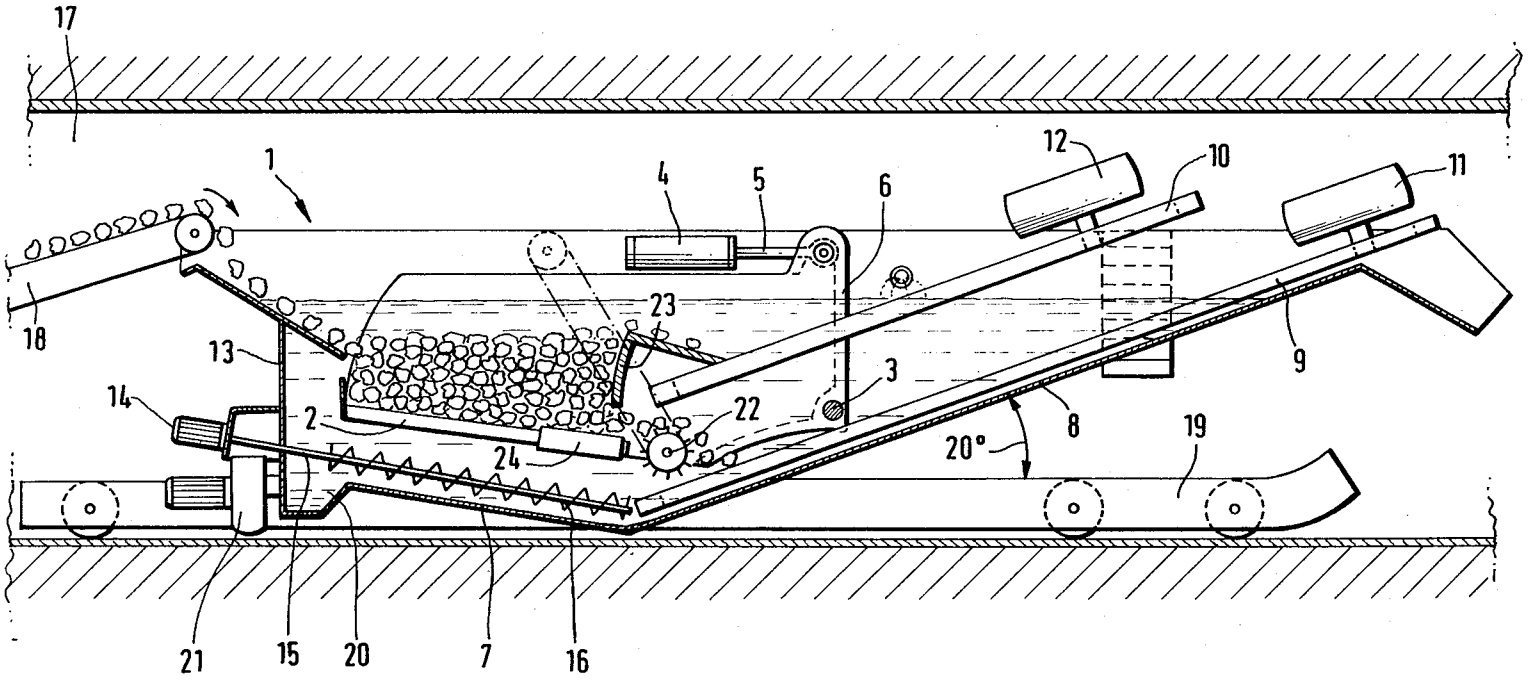
FIG. 1 is a side elevation of a movable sieve jigging machine constructed in accordance with the present invention.

Referring to FIG. 1, illustrated is a jigging machine constructed in accordance with the present invention and comprising a housing 1 having a jig bed 2 disposed therein and mounted for oscillation. The jig bed 2 is rotationally seated on a shaft 3 connected to the sidewalls of the housing 1. A piston-cylinder 4 whose piston rod 5 is hinged to the frame 6 of the jig bed 2 and which is disposed roughly horizontally relative to the jig bed serves as the oscillatory drive.

The floor of the hutch 1 comprises two inclined portions 7 and 8, whereby the rise of the floor portion 8 towards the solids discharge end relative to the horizontal in a range of 15° to 25°and here amounts to about 20° in accordance with the present invention. In this manner, the solids discharge is facilitated in a very advantageous way, namely given a low overall height of the jigging machine. In addition, two conveyor elements 9 and 10 for the lower deads discharge and the upper valuable material discharge, which are disposed vertically spaced from one another, are also located in the housing 1, this enabling a particularly narrow structure of the jigging machine. The conveyors 9 and 10 are equipped with drive units 11 and 12, respectively, and can be designed, for example, as simple chain conveyors or as double track chain conveyors. Given high conveying power, chain conveyors enable a good dewatering of the solids in the region of the rising floor portion 8. The valuable materials are thereby laterally discharged and the addles are discharged via the end wall, both being discharged from a housing 1 by way of chutes or slides.

At the left-hand side of FIG. 1, the housing 1 comprises a vertically extending wall 13 at the exterior of which a drive unit 14 is located, the drive unit 14 communicating via a drive shaft 15 with a solids conveyor screw 16 located and extending parallel above the bottom portion 7. A sump 20 located lower is disposed in the floor portion 7 of the housing 1 directly preceding the vertically extending wall 13, the material in the housing descending to the floor portion 7 and being transported in this sump by the solids conveyor screws 16. A conveyor 21, for example a solids pump, is connected to the sump 20 in a very advantageous manner for a hydraulic discharge of the material. The material in the housing is conveyed by the conveyor 21 via a conduit (not illustrated in detail) to the conveyor 10 for the valuable material discharge which is located above the floor portion 8 of the housing 1.

Since the outer dimension of the jigging machine with respect to the height and width thereof is designed smaller than the cross-section of a tunnel 17, as illustrated in FIG. 1, it can very advantageously be utilized in underground mining operations for preseparation of the deads produced during mining with the valuable materials, for example coal. The jigging machine of the present invention is thereby very advantageously equipped with adisplaceable support 19 which comprises, for example, a frame and rollers or, respectively, chains, or of a carriage with glide rails, so that it can be directly connected to the respective face conveyor device and, under given conditions, to a pre-crusher and can be displaced together therewith.

During operation of the jigging machine of the present invention, the deads/mineral mixture produced during extraction, for example the coal obtained during extraction, is supplied with the deads via a conveyor 18, for example a flat conveyor belt, to the jigging machine at the left-hand side, as illustrated in FIG. 1, and is delivered therein to the jig bed 2 which is placed in an up and down oscillatory motion via the rotational shaft 3 with the assistance of the piston-cylinder unit 4. The deads/coal mixture respectively located on the jig bed is thereby separated by the separating fluid located in the housing, for example water, which, in a pulsating manner, passes through the openings of the jig bed floor equipped with a sieve or perforate plate and the deads/-coal mixture is thereby stratified based on different specific gravities of the materials so that the coal comes to lie on top of the deads. The deads are piled up by a discharge drum 22, for example a spiked roller, located at the end of the jig bed 2 so that an adequate layer thickness of deads arises on the jig bed. The discharge drum 22 is secured to the frame or, respectively, in the vertical lateral walls of the jig bed 2 and is driven by way of a mechanical drive (not shown on the drawing) for example by means of a chain. The coal lying on the deads layer is likewise piled up by a variable height retaining wall 23 secured to the jig bed frame. Due to the constant feed of the raw coal/deads mixture obtained during extraction into the jigging machine with the conveyor belt 18, the sorted raw coal is fed over the retaining wall 23 and onto the upper conveyor 10.

In the direction towards the solids discharge side, the jig bed 2 is provided with an elastically displaceable pressure gauge frame 24 in front of the spiked roller 22. This pressure gauge frame 24 contains a plurality of manometer sockets which are in communication with a regulator via electrical lines. When a freely selectable pressure of deads components on the pressure gauge frame 24 is exceeded, for example a reference value of 300 kg, the drive of the discharge drum 22 is driven or, respectively, engaged via the regulator and the dammed-up deads particles are supplied via the spiked roller 22 to the lower conveyor 9. As a result, it is very advantageously achieved that an adequate layer thickness of deads always remains on the jig bed 2, so that raw coal pieces are reliably prevented from proceeding into the deads discharge and leading to losses of valuable material.

The sorted raw coal is discharged from the housing 1 with the upper conveyor 10 via a side discharge chute, whereas the deads located therebelow, after they depart the jig bed 2, proceed via the discharge drum 22 onto the double track chain conveyor 9 and are discharged out from the jigging machine by the conveyor 9 separated from the raw coal. The material in the housing thereby passing down through the openings of the jig bed 2 is very advantageously acquired by the solids conveyor screw 16 located in the housing 1 and extending roughly horizontally, and slightly upward, and is transported into the sump 20, is supplied by the solids pump 21 via a conduit to the conveyor 10, for example a double track conveyor chain, and is discharged by the latter together with the raw coal.

Figure 2:
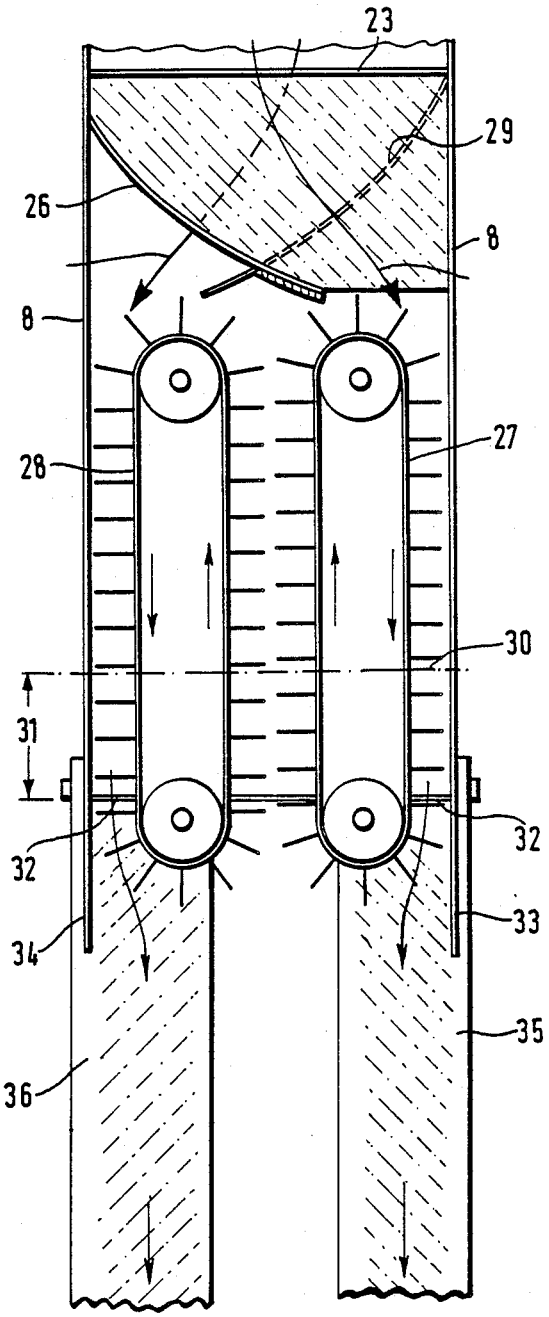
FIG. 2 is a plan view of the discharge end of a different embodiment of a movable sieve jigging machine constructed in accordance with the present invention and having discharge devices disposed next to one another.

A further embodiment of the invention is illustrated in FIG. 2 in which the two conveyors for the deads and the coal discharge are disposed in the housing side-by-side at a distance from one another. The required structural height of the jigging machine is thereby further reduced in an extremely advantageous manner.

By way of a baffle 26, the raw coal falling over the retaining wall 23 is fed onto one side or, respectively, half of the ascending floor portion 8 of the housing 1 and is discharged from the housing 1 with the chain conveyor 27. In a corresponding manner, the deads are conducted by way of a baffle 29 onto the other side or, respectively, half of the ascending floor portion 8 of the housing 1 and a discharge from the housing 1 with the further, parallel chain conveyor 28.

The line of emergence of the conveyed solids from the separating fluid is referenced 30. The path or, respectively, the distance 31 between the line 30 (the emergence of the solids from the separating fluid) and the discharge of the solids over the front edge 32 of the ascending floor portion 8 of the housing 1 must be sufficiently long in order to achieve an adequate dewatering of the solids during conveying of the solids from the housing 1 by, for example, the chain conveyors 27, 28 illustrated in FIG. 2. In that the water in the jigging machine does not fulfill any conveying function (doing so only when conveying the housing material from the sump 20 onto the valuable discharge conveyor 10 or, respectively, 27 by way of the solids pump 21), but only fulfills the separating function, a dirty water processing can be very advantageously eliminated due to the adequate dewatering of the solids. The jigging machine of the present invention is also particularly suited for processing coarse grain charging material, for example having a piece size of 30–400 mm. The water does not have to be kept clean, so that the jigging machine functions with only one fill of separating fluid or, respectively, water. Only the surface water adhering to the discharged, sorted deads and raw coal needs to be replaced or, respectively, replenished.

A concentration of a braided material or of superfine material in the water, fundamentally in the formation of a slurry, is not disruptive given the processing piece sizes up to about 400 mm. At some point or other, a condition of equilibrium occurs in the separating fluid, so that superfine material newly introduced into the jigging machine is co-discharged as particles adhering to the coarse-grain deads and raw coal particles since it is already contained in saturation in the water.

The sorted deads and raw coal quantities separately discharged from the housing 1 with the,chain conveyors 27, 28 are conducted by lateral baffles 33, 34 onto suitable conveyors 35, 36, for example belt conveyors (or vibratory conveyors given a change of the conveying direction) and are conveyed off in accordance with their further utilization. The deads remain underground as fill material for extracted tunnels or, respectively, processing stages (for example, comminution, sieving, heavy slurry classification) or, respectively, can be conveyed above ground with a reduced lifting power.

The particular advantage of the jigging machine construted in accordance with the present invention is that it can be utilized in underground mining operations for preseparation ofthe deads from the valuable materials such as, for example, coals,ores or other mine materials (for example bauxite) and, due to the displaceability of the jigging machine, a follow-up is enabled given progressive tunnel extraction. The deads arising in the preseparation operation can very advantageously remain in the underground working as debris, i.e. as filling material, or the like, and need not be conveyed above ground. Due to the sorting of the deads ballast, this enables relief of the tunnel and shaft conveying and, therefore, a considerable saving in terms of energy and expense.

Figure 3:
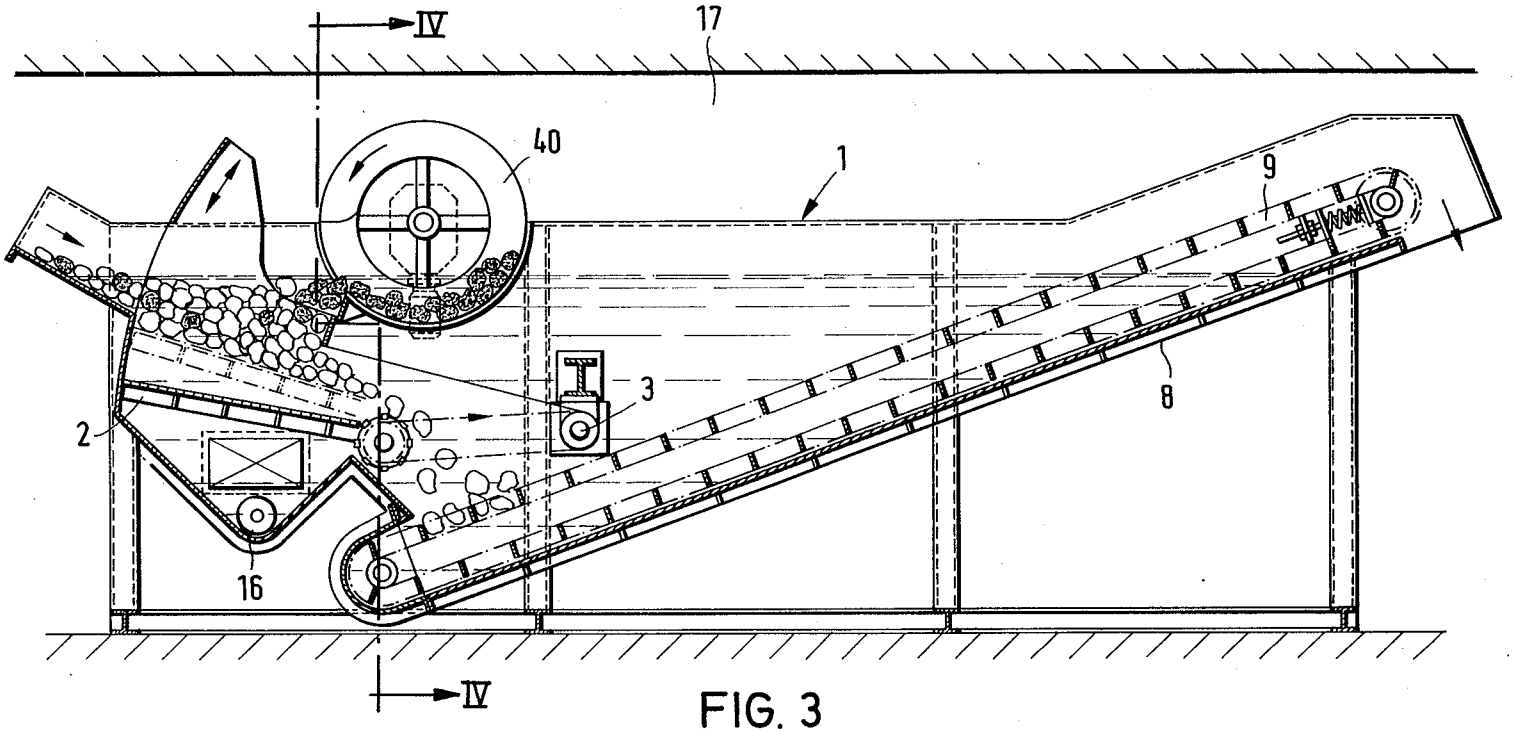
FIG. 3 is a sectional side elevation of a movable sieve jigging machine constructed in accordance with the present invention and comprising a discharge screw.
Figure 4:
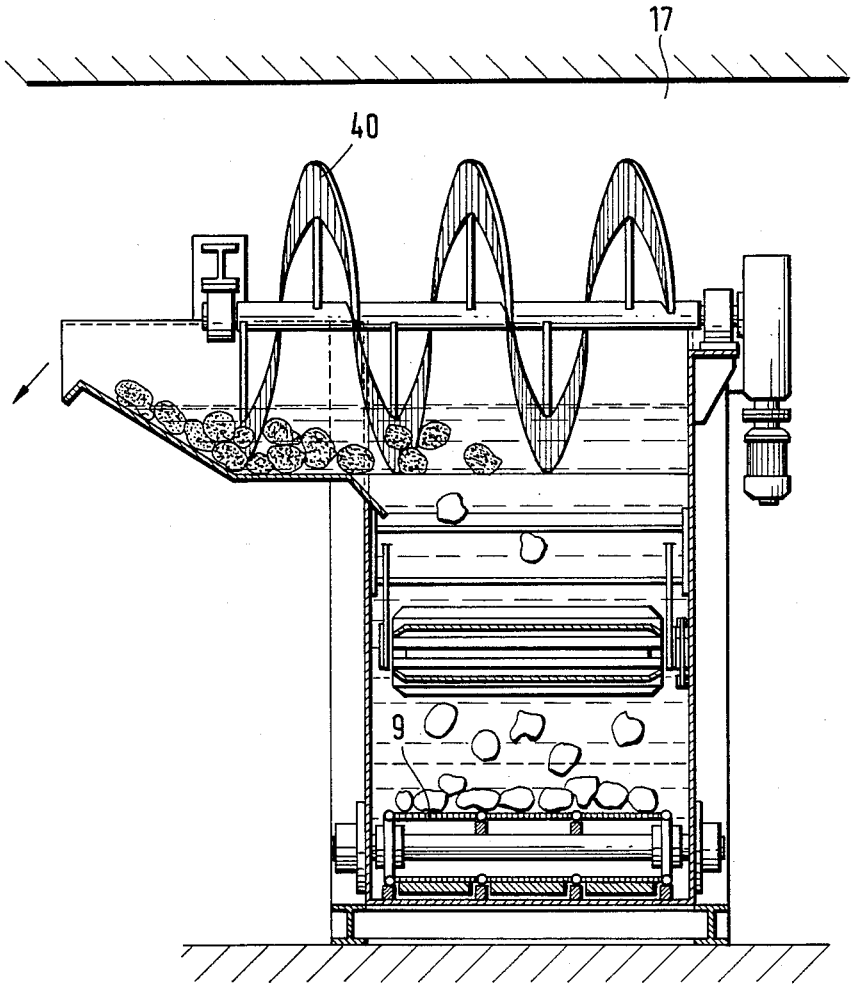
FIG. 4 is a sectional view taken substantially along the parting line IV—IV of FIG. 3.

Another advantageous design of a movable sieve jigging machine is illustrated in FIGS. 3 and 4. A jig bed 2 rotationally displaced around the shaft D at the discharge ide is located in the housing 1. The piston-cylinder unit for driving the jig bed 2 is not illustrated. It is applied such that it does not project above the minimum height defined by the size of the housing and the deads discharge conveyor 9.

Here, also, the housing 1 is designed as a flat trough towards the dead discharge side. The slope of the floor portion 8 here also amounts to 20° . The conveyor 9 for the deads discharge extends parallel thereto.

In this jigging machine, the coal is laterally discharged by the screw 40 above the jig bed 2. This discharge enables a rather narrow structure of the jigging machine. Similar to FIG. 1, it can also be executed as a semi-mobile device and can be displaced together with the extraction conveying device.

Similar to FIG. 1, a solids conveyor 16 which discharges the descending material from the housing is provided below the jig bed 2.

FIG. 4 illustrates, in cross-section, the jigging machine at the level of the discharge screw.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An underground mobile jigging machine for separating a mixture of deads and valuable material in an underground tunnel, comprising:

a housing including a charging end and a deads discharge end, for holding a separating liquid;

a perforate jig bed pivotally mounted in said housing in the separating liquid for receiving the mixture thereon;

oscillating drive means, including a piston cyinder connected to said perforate jig bed for oscillating the mixture, and the separating liquid, to cause startification thereof with the valuable material on top of the deads;

a first conveyor communicating with the deads layer for conveying off the deads;

a second conveyor constructed as a screw conveyor communicating with the valuable material layer for carrying off the valuable material, said housing comprising a trough including a floor disposed at an upward angle, with respect to the horizontal, towads the deads discharge end, said first conveyor extending parallel to said floor;

mobile support means supporting said housing from movement along the foor of the tunnel;

a sump in said housing for receiving valuable material passing through said perforate jig during separation; and pump means connected to said sump and communicating with said second conveyor to provide a hydraulic discharge of the valuable material from said second conveyor.

2. The underground jigging machine of claim 1, wherein:

the angle of said housing floor is in the range of 15° to 25°.

3. The underground jigging machine of claim 1, wherein:

the angle of said housing floor is 20°.

* * * * *